US005894316A

United States Patent [19]

Sakai et al.

[11] Patent Number: 5,894,316

[45] Date of Patent: Apr. 13, 1999

[54] INK JET HEAD WITH DIAPHRAGM HAVING VARYING COMPLIANCE OR STEPPED OPPOSING WALL

[75] Inventors: Shinri Sakai; Masahiro Fujii, both of Suwa, Japan

[73] Assignee: Seiko Epson Corporation, Tokyo, Japan

[21] Appl. No.: 08/635,113

[22] Filed: Apr. 19, 1996

[30] Foreign Application Priority Data

Apr. 20, 1995 [JP] Japan ..... 7-095708
Jul. 27, 1995 [JP] Japan ..... 7-192283

[51] Int. Cl.[6] ..... B41J 2/04

[52] U.S. Cl. ..... 347/54; 347/94

[58] Field of Search ..... 347/20, 54, 70, 347/94, 68

[56] References Cited

U.S. PATENT DOCUMENTS

| | | | |
|---|---|---|---|
| 4,523,200 | 6/1985 | Howkins | 347/71 X |
| 4,888,598 | 12/1989 | Heinzl et al. | 347/70 |
| 5,424,769 | 6/1995 | Sakai et al. | 347/70 |
| 5,513,431 | 5/1996 | Ohno et al. | 347/54 X |
| 5,534,900 | 7/1996 | Ohno et al. | 347/54 |
| 5,644,341 | 7/1997 | Fujii et al. | 347/54 X |

FOREIGN PATENT DOCUMENTS

| | | | |
|---|---|---|---|
| 0 375 147 | 6/1990 | European Pat. Off. . | |
| 0 479 441 A2 | 4/1992 | European Pat. Off. . | |
| 0 573 055 | 12/1993 | European Pat. Off. . | |
| 0 580 154 | 1/1994 | European Pat. Off. . | |
| 0 608 835 | 8/1994 | European Pat. Off. . | |
| 0 629 503 | 12/1994 | European Pat. Off. . | |
| 55-79171 | 7/1980 | Japan . | |
| 5-50601 | 3/1993 | Japan . | |
| 671882 | 3/1994 | Japan | 347/68 |
| 6-320725 | 11/1994 | Japan . | |

OTHER PUBLICATIONS

Patent Abstracts of Japan, Pub. No. 56161172, Dec. 11, 1981.

*Primary Examiner*—Benjamin R. Fuller
*Assistant Examiner*—C. Dickens
*Attorney, Agent, or Firm*—Mark P. Watson

[57] ABSTRACT

An improved ink jet head is provided. This improved ink jet head comprises a diaphragm, which is part of an ink chamber. The diaphragm includes a segment which contacts an opposing wall by a drive voltage lower than that for the rest of the diaphragm. The ink jet head also comprises an opposing wall opposite to the diaphragm. When the pressure for ink droplet ejection is generated, the segment of the diaphragm contacts the opposing wall, creating an extremely low compliance state. After ink droplet ejection, the segment of the diaphragm separates from the opposing wall, producing a high compliance state that absorbs the pressure created in the ink chamber by oscillation in the ink channel. Thus, pressure in the ink chamber resulting from ink vibration in the ink path including the ink chamber is buffered to prevent satellite emissions. When plural different gaps are formed between the diaphragm and the opposing wall to create the segments requires different drive voltage for contacting the opposing wall, the part of the diaphragm contributing to ink droplet ejection can be selected by appropriately controlling the voltage applied to opposing electrodes. The mass of the ejected ink droplets can thus be variably controlled. Drive at a lower drive voltage is also possible because contact with the opposing wall is propagated from the segment of the diaphragm to the other parts of the diaphragm. A high ink nozzle density is also achieved in an ink jet head using an electrostatic actuator without increasing the drive voltage.

9 Claims, 15 Drawing Sheets

INK JET HEAD WITH DIAPHRAGM HAVING VARYING COMPLIANCE OR STEPPED OPPOSING WALL

BACKGROUND OF THE INVENTION

1. Field of the Invention

The present invention relates to the structure of an ink jet head, and relates particularly to a technology for controlling the pressure in the pressure generating chamber that applies an ejecting pressure to the ink contained in the chamber.

2. Description of the Related Art

In general, an ink jet head comprises a pressure generating chamber for applying pressure to ink to eject the ink from a nozzle. One end of the pressure generating chamber is typically connected to an ink tank through an ink supply path, and the other end to a nozzle opening from which the ink drops are ejected. Part of the pressure generating chamber is made to be easily deformed and functions as a diaphragm. This diaphragm is elastically displaced by an electromechanical conversion means to generate the pressure that ejects ink drops from the nozzle opening.

Recording apparatuses using this type of ink jet head offer outstanding operating characteristics, including low operating noise and low power consumption. They are widely used as hard copy output devices for a variety of information processing devices. As the performance and functionality of information processing devices has improved, demand has also risen for even higher quality and speed printing both text and graphics. This has made urgent the development of technologies enabling even finer and smaller ink drops to be ejected consistently at even higher frequencies i.e., higher printing speed.

(1) Ink eject frequency

Because of the structure of the ink jet head as described above, after ink ejection, vibration remains in the ink inside the pressure generating chamber (also called the ink chamber because it is filled with ink; hereafter "ink chamber"). This residual vibration can easily result in the formation of undesirable ejected ink droplets (also called "satellites"). To avoid this, the flow resistance of the ink supply path connecting the ink chamber and ink tank is conventionally set high as a means of accelerating attenuation of residual ink vibration. However, if the flow resistance of the ink supply path is high, the refill supply rate of ink to the ink chamber, after ink ejection, drops, thereby lowering the maximum ink eject frequency, and thus lowering the printing speed of the printing device.

The applicants thus developed and disclosed in JP-A-H6-320725 (1994-320725) a technology for forming a thin-wall part in the diaphragm to create a flexible wall that deforms according to the pressure inside the ink chamber. This thin-wall part is used to absorb residual ink vibration in the ink chamber as a means of avoiding undesirable ink ejection or satellite emissions. It is therefore not necessary to set the flow resistance of the ink supply path high because ink ejection does not occur even if there is residual ink vibration, and the ink ejecting frequency can therefore be increased.

With regard to the technology described in JP-A-H6-320725 (1994-320725), the compliance (i.e., volume change per unit pressure) of the ink chamber increases due to the thin-wall part of the diaphragm. While this reduces satellites, the ejecting speed required for stable ink ejection cannot be obtained because the pressure generated by the diaphragm for ink ejecting is not used effectively for propelling the ink drops. Furthermore, when the diaphragm drive force is increased to assure sufficient ejecting speed, a higher drive voltage is required. This, in turn, increases both the size of the drive device and power consumption.

(2) Improving image quality with technologies for varying droplet size

Expressing various density gradations by changing the size of the ink droplets formed on the recording medium is a preferred means of improving image quality. The size of the ink droplets output by any recording apparatus (printer) using an ink jet head is determined by various factors, one of which is the size (also called "ink ejection mass") of the ink drops ejected by the ink jet head.

A technology providing plural electrostrictive means of different sizes in the ink chamber, and separately controlling and driving these electrostrictive means to eject ink droplets of various sizes, is described in JP-A-S55-79171 (1980-79171).

When the technology described in JP-A-S55-79171 (1980-79171) is applied, each of the plural, different size actuators used to deform the diaphragm must be independently driven, resulting in increasing the number of wires needed, and thus making it difficult to achieve a high nozzle density. The number of drivers also increases because of the need to separately drive each actuator, and this makes it difficult to reduce the device size.

(3) Improving image quality through a high droplet density

Most ink jet heads usually have plural nozzles arrayed in a straight line. Printing devices using such ink jet heads output two-dimensional images by moving the ink jet head across the recording medium in a direction roughly perpendicular to this nozzle line. Therefore, to achieve high image quality by increasing the ink droplet density, it is necessary to reduce the distance between adjacent nozzles (also known as the "nozzle pitch").

An ink jet head using an electrostatic actuator developed and manufactured by the applicants can be manufactured using a production process similar to that used for semiconductor manufacture, and is one of the technologies best suited to achieving a high ink droplet density. The basic structure of this ink jet head is described in JP-A-H5-50601 (1993-50601), and can be used to reduce the nozzle pitch without changing the size of the ink drops by narrowing the width and increasing the length of the ink chamber.

An ink jet head using electrostatic actuators as described in JP-A-H5-50601 (1993-50601) can decrease the nozzle pitch without changing the size of the ink droplets. In this case, however, the diaphragm compliance increases significantly as described below, and an extremely high voltage is therefore required to drive the electrostatic actuator. In general, the load on the drive device increases as the drive voltage increases, and measures to prevent unnecessary radiation are difficult. As a result, it is difficult to actually use this type of ink jet head in a printing device.

SUMMARY OF THE INVENTION

To solve the above problems, an ink jet head according to the present invention comprises an ink jet head unit which comprises a nozzle, a pressure chamber having an opening in communication with the nozzle, an ink supply path for supplying ink to the pressure chamber, a pressure generating means for generating pressure to cause ink vibration in the pressure chamber pressure for ejecting ink drops through the nozzle, an absorbing means for absorbing pressure resulting from vibration of the ink in the pressure chamber, and a limiting means for limiting the pressure absorption by the absorbing means to a predetermined amount when the pressure generating means generates pressure for ejecting the ink drops.

According to the invention, the absorbing means absorbs pressure by vibration when ink vibration occurs in the pressure chamber. The limiting means includes a vibration limiting means for limiting the vibration of the absorbing means. The pressure generated by the pressure generating means can be effectively used for ink droplet ejection because the absorbing means vibrates to a limited extent as a result of the ink vibrations while the pressure generating means generates the pressure for ejecting the ink droplets. Furthermore, satellite emissions can also be suppressed because the pressure caused by vibration of the ink thereafter is absorbed by the absorbing means.

If a plurality of ink jet head units each having substantially the same structure as described above are provided, the specific vibration frequency of the ink system differs during ink ejection and standby states, thus effectively suppressing resonance between adjacent ink jet head units.

A flexible wall disposed as one wall member of the pressure chamber may be used as the absorbing means. An opposing wall disposed externally to the pressure chamber at a position opposing the flexible wall may be used as the vibration limiting means. In this case, the vibration limiting means may include a deformation means for deforming the flexible wall to cause the flexible wall to contact the opposing wall. The deformation means may be, for example, conductive members disposed in the flexible wall and opposing wall. The deformation means may generate an attraction force between the flexible wall and opposing wall upon an application of a voltage to the conductive members. The attraction force can cause the two walls to contact each other.

The pressure generating means is preferably an electrostatic actuator that includes a diaphragm forming one wall of the pressure chamber and the opposing wall disposed opposite to the diaphragm and externally to the pressure chamber. The diaphragm and the opposing wall act as opposing electrodes. The pressure generating means elastically displaces the diaphragm according to the drive voltage applied between the opposing electrodes. In this case, the absorbing means is comprised of a segment of the diaphragm, the segment requiring lower drive voltage for contacting the opposing wall than that for the rest of the diaphragm. The vibration limiting means is comprised of the opposing wall opposing that segment of the diaphragm.

In this case, the pressure chamber is preferably a long, narrow member and has one end connected to the ink supply path and the other end connected to a nozzle. The segment of the diaphragm is disposed near the end of the pressure chamber connected to the ink supply path.

When the drive voltage is applied in this case, the segment of the diaphragm deforms for the first time and pulls ink through the ink supply path. Then, deformation of the diaphragm is propagated towards the nozzle. This creates a flow of ink from the ink supply path to the nozzle, and accomplishes a smooth ink supply.

The segment of the diaphragm may also be a low rigidity member with less rigidity than the other parts of the diaphragm. Specifically, the low rigidity member may be a part of the diaphragm that is thinner than the other parts of the diaphragm. If the diaphragm has a long, narrow shape, the low rigidity member may be a lengthwise part of the diaphragm that is wider than the other parts of the diaphragm.

In one embodiment, the diaphragm comprises N segments in opposition to the opposing wall such that N gaps are formed in diminishing size between the N parts of the diaphragm and the opposing wall, respectively, where N is greater than two. Any of the N parts of the diaphragm except the one corresponding to the largest gap may function as the segment of the diaphragm. In this case, the N segments of the diaphragm are formed by forming the opposing wall in a stepped configuration.

A printing apparatus according to the present invention includes an ink jet head described above and a drive means for driving the ink jet head. The drive means for the ink jet head in this printing apparatus comprises a drive circuit capable of applying different drive voltages to the electrostatic actuator at different timing. The different drive voltages includes a first drive voltage capable of forcing all N segment of the diaphragm to contact the opposing wall; a second drive voltage capable of maintaining contact between at least one of the N segments and the opposing wall with the other parts of the diaphragm being released; a third drive voltage capable of releasing contact between all of the N segments of the diaphragm and the opposing wall; and a group of drive voltages capable of maintaining contact between only selected ones of the N segments of the diaphragm and the opposing wall.

The drive circuit in this case may further comprise a charge/discharge circuit for charging and discharging the electrostatic actuator. The charge/discharge circuit comprises a charging circuit for charging the electrostatic actuator to at least the first drive voltage; a first discharge circuit for discharging the electrostatic actuator at a first discharge rate to a selected voltage in the group of voltages; and a second discharge circuit for discharging the electrostatic actuator at a second discharge rate to a selected voltage in the group of voltages. The second discharge rate is lower than the first discharge rate.

When the ink jet head comprises a plurality of ink jet head units, the drive circuit comprises a plurality of switching means for controlling the charge/discharge circuit to charge and discharge the individual electrostatic actuators according to an externally supplied print signal. In this embodiment, each switching means is connected to one of the opposing electrodes, and the charge/discharge circuit is commonly connected to the other one of the opposing electrodes.

A printing apparatus control method according to the present invention comprises a first process for applying the first drive voltage to the electrostatic actuator; a second process for applying the second drive voltage to the electrostatic actuator after a first predetermined time has passed after the first process; and a third process for applying the third drive voltage to the electrostatic actuator after a second predetermined time has passed after the second process.

In this case, a process for selecting one drive voltage from the group of voltages as the second drive voltage according to the print signal may be performed before the second process of the preceding method. It is therefore possible to select the part of the diaphragm contributing to ink droplet ejection. The ejected ink droplet mass can be varied according to the print signal. This technique enables printing various density gradations.

When the drive circuit comprises a charge/discharge circuit as described above, the control method further preferably comprises a first process for charging the electrostatic actuator to at least the first drive voltage; a second process for discharging the electrostatic actuator to the second drive voltage at a first discharge rate after a first predetermined time has passed after the first process; and a third process for discharging the electrostatic actuator at a second discharge rate after the second process.

When the ink jet head comprises a plurality of ink jet head units, a process for setting the open/closed state of the switching means according to the print signals must be performed before the first process described above.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIG. 3A shows the standby state, FIG. 3B shows the state when ink is supplied, and FIG. 3C shows the state when the ink is compressed or pressurized.

DESCRIPTION OF THE PREFERRED EMBODIMENTS

Figure 1:
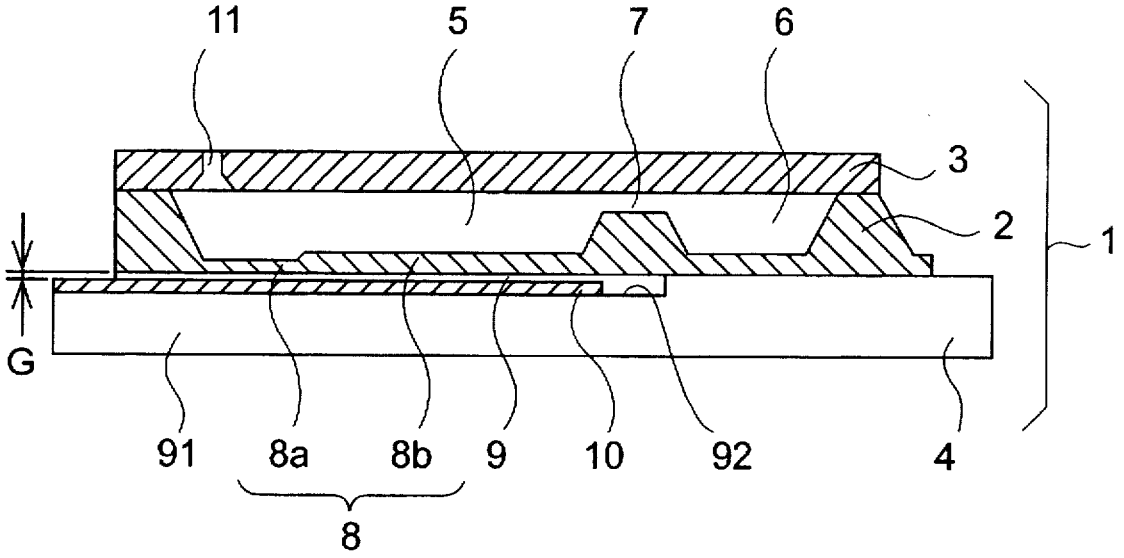
FIG. 1 is a simplified longitudinal cross-sectional view of a preferred embodiment of an ink jet head of FIG. 2 along line I—I, according to a first embodiment of the present invention.
Figure 2:
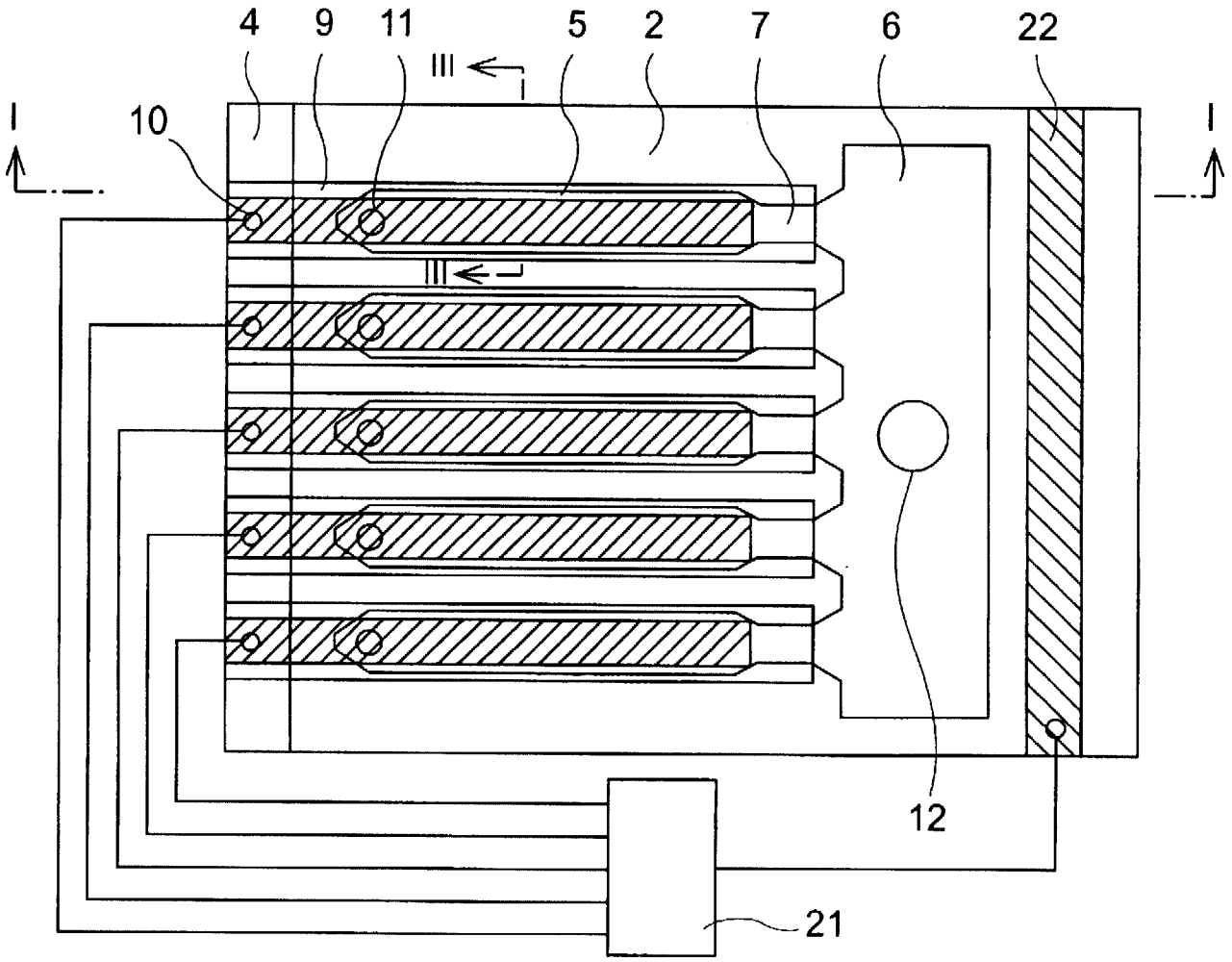
FIG. 2 is a plan view of the embodiment of the ink jet head shown in FIG. 1.

FIG. 1 is a cross-sectional view of an ink jet head according to the present invention. FIG. 2 is a partial plan view of FIG. 1, and FIGS. 3A–3C are partial cross-sectional views of FIG. 2.

As shown in these figures, ink jet head 1 is a three-layer lamination which includes a nozzle plate 3 comprising, for example, silicon, a glass substrate 4 comprising, for example, borosilicate having a thermal expansion coefficient close to that of silicon, and a center substrate 2 comprising, for example, silicon. Plural independent ink chambers 5, common ink chamber 6 shared by all ink chambers 5, and ink supply paths 7 connecting common ink chamber 6 to each of the independent ink chambers 5, are formed in the center silicon substrate 2 by, for example, etching channels corresponding to each of these components in the surface of silicon substrate 2 (i.e., the top surface as seen in FIG. 1). After etching, nozzle plate 3 is bonded to the surface of silicon substrate 2 to complete the formation of the various ink chambers and ink supply paths.

Ink nozzles 11 open into the corresponding ink chambers 5 are formed in nozzle plate 3 at positions corresponding to the end of each ink chamber 5. As shown in FIG. 2, ink supply port 12 continuous to common ink chamber 6 is also formed in nozzle plate 3. Ink is thus supplied from an external ink tank (not shown in the figures) through ink supply port 12 to common ink chamber 6. The ink stored in common ink chamber 6 then passes through ink supply paths 7, and is supplied to each of the independent ink chambers 5.

Ink chambers 5 are formed with a thin bottom wall 8 to function as a diaphragm elastically displaceable in the vertical direction as seen in FIG. 1. To simplify the description of this bottom wall 8 below, bottom wall 8 may also be referred as diaphragm 8.

At the bottom of silicon substrate 2 are formed shallow etched recesses 9 at positions corresponding to each of the ink chambers 5 in silicon substrate 2. As a result, bottom wall 8 of each ink chamber 5 faces recess surface 92 with an extremely narrow gap G therebetween about 1 μm, for example. Also, a part of glass substrate 4 is disposed opposite bottom walls 8 of ink chambers 5, and is referred to as a diaphragm-opposing wall 91, or simply opposing wall 91.

Figure 3A:
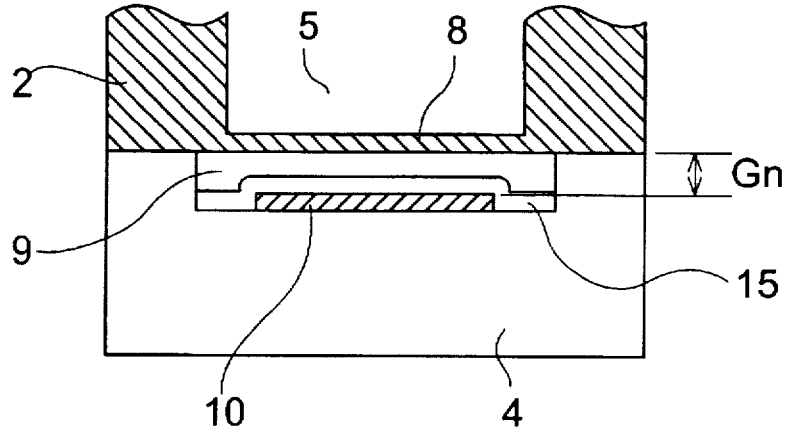
FIGS. 3A, 3B and 3C are simplified side cross-sectional views of the ink jet head shown in FIG. 2 along line III—III.
Figure 3B:
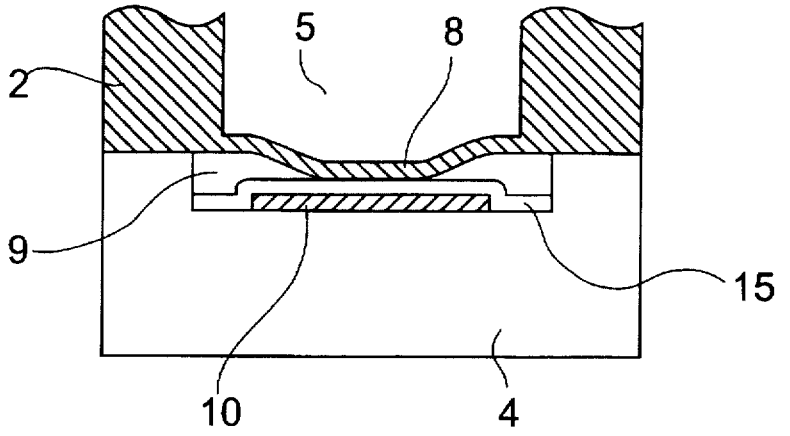
Figure 3C:
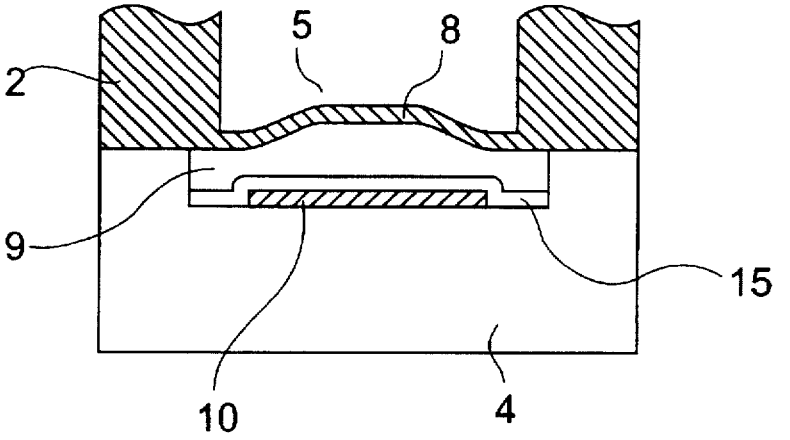

The bottom wall 8 of each ink chamber 5 functions in this embodiment as an electrode. An electrode segment 10 is also formed on recess surface 92 of glass substrate 4 opposing bottom wall 8 of each ink chamber 5. The surface of each electrode segment 10 is covered by insulation layer 15 comprising, for example, glass, and having a thickness G0 as shown in FIGS. 3A–3C. As a result, electrode segment 10 and bottom wall 8 of each ink chamber form opposing electrodes separated by insulation layer 15 and having an electrode gap of Gn.

As shown in FIG. 2, drive circuit 21 for driving the ink jet head charges and discharges the opposing electrode gaps according to a print signal applied from an external source, such as a host computer, not shown in the figures. One output of drive circuit 21 is connected directly to each electrode segment 10, and the other output is connected to common electrode terminal 22 formed in silicon substrate 2. Drive circuit 21 will be described in detail later.

To make silicon substrate 2 conductive and function as an electrode, impurities are implanted to silicon substrate 2, which is therefore capable of supplying a charge from common electrode terminal 22 to bottom wall 8. Note that when it is necessary to supply a voltage to the common electrode with low electrical resistance, a thin-film of gold or other conductive material can be formed by vapor deposition, sputtering, or other process on one surface of the silicon substrate. Silicon substrate 2 and glass substrate 4 are bonded by an anodic bond in this embodiment. A conductive film is therefore formed on the surface of silicon substrate 2 in which the ink supply paths are formed.

Cross-sectional views taken along line III—III in FIG. 2 are shown in FIGS. 3A–3C. When a drive voltage is applied from drive circuit 21 to the opposing electrode gap, a Coulomb force in the form of an attraction force generated in the opposing electrode gap deflects bottom wall or diaphragm 8 toward electrode segment 10, thereby increasing the capacity or volume of ink chamber 5, as shown in FIG. 3B. When the charge stored to the opposing electrode gap is then rapidly discharged by drive circuit 21, bottom wall 8 returns to the original position due to the resiliency or restoring force of the material, thus rapidly reducing the volume of ink chamber 5, as shown in FIG. 3C and increasing the pressure. The pressure thus generated inside the ink chamber by the return of bottom wall 8 forces part of the ink stored in ink chamber 5 to be ejected as ink droplets from the ink nozzle 11 leading from that ink chamber. A detailed description of drive circuit 21 is presented herein below.

Figure 4:
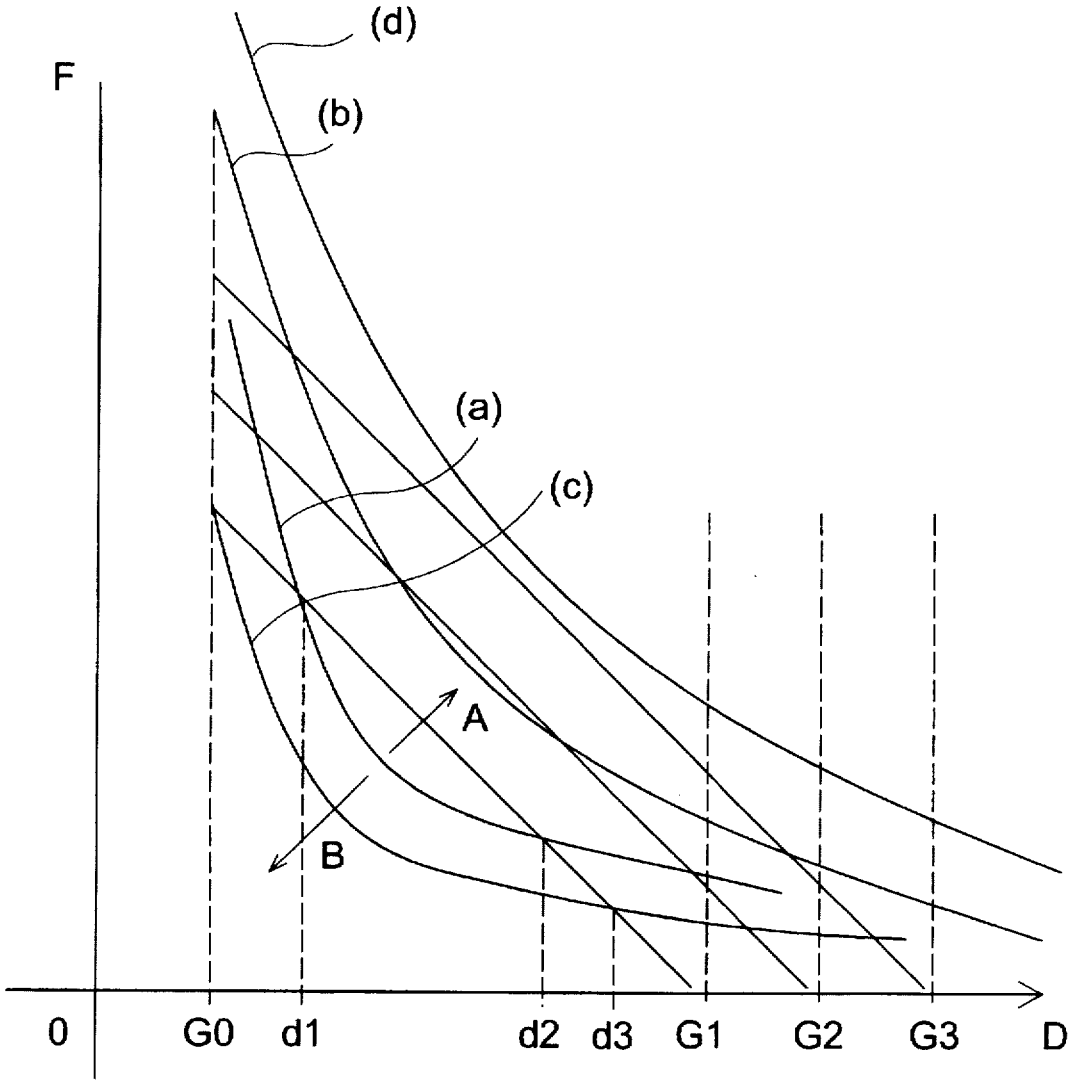
FIG. 4 is a graph showing the relationship between the distance from the electrode segment and the force acting on the diaphragm when the diaphragm is displaced.

The relationship between the voltage applied to the opposing electrode gap and the behavior of bottom wall 8 is described next with reference to FIG. 4. FIG. 4 is a graph showing the relationship between the distance from electrode segment 10 and the force acting on diaphragm 8 when diaphragm 8 is displaced.

The restoring force of diaphragm 8 is shown by the straight lines in FIG. 4. Note that the restoring force of diaphragm 8 increases proportionally to the displacement as diaphragm 8 is deformed or displaced from the position of gap length G1 toward the electrode segment. The absolute value of the slope of the restoring force line expresses the compliance of diaphragm 8; as compliance increases, the slope decreases. The curved lines in FIG. 4 indicate the Coulomb force generated in the opposing electrode gap; the Coulomb force is inversely proportional to the square of the opposing electrode gap for any constant applied voltage. Because the Coulomb force is also proportional to the square of the applied voltage, curve (a) shifts in the direction of arrow A as the applied voltage increases, and shifts in the direction of arrow B as it decreases.

Figure 9:
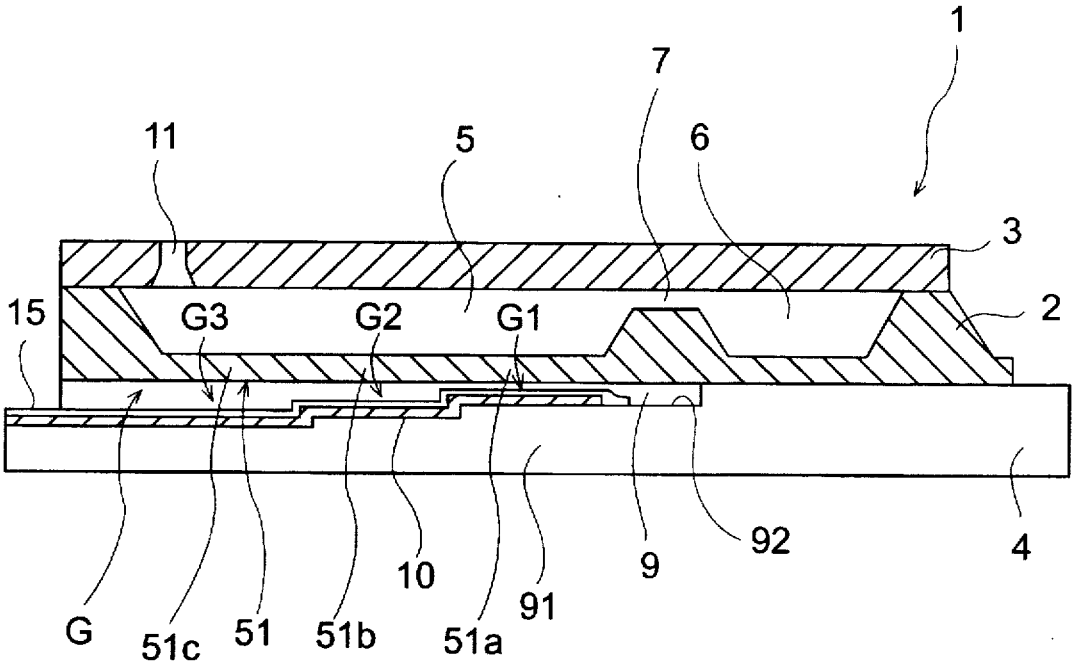
FIG. 9 is a simplified side cross-sectional view of an ink jet head according to a second embodiment of the present invention.
Figure 10:
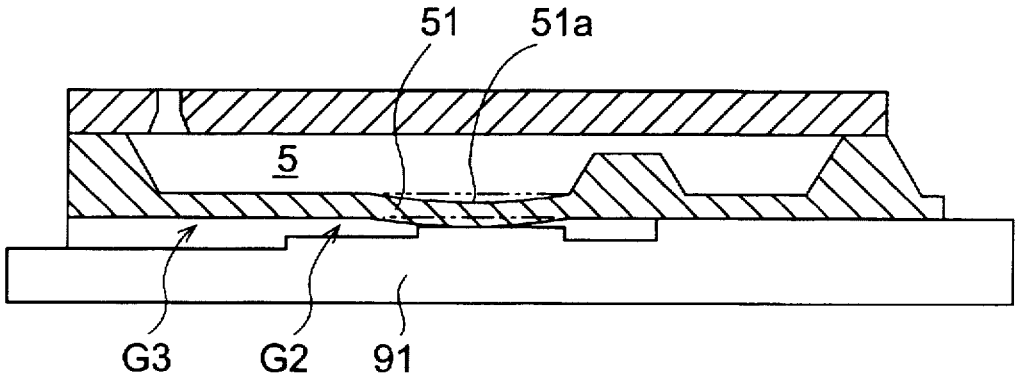
FIG. 10 illustrates the operation of the ink jet head according to the second embodiment of the present invention shown in FIG. 9.

FIG. 4 also illustrates the restoring force of diaphragm 8 when a plurality of gaps, for example, G1, G2 and G3 are formed between the opposing electrodes as in the second embodiment shown in FIG. 9. This second embodiment will be described in detail below.

G0 in FIG. 4 is the thickness of insulation layer 15 shown in FIGS. 3A–3C. At this position, diaphragm 8 contacts the opposing wall. In case of the gap length G1, values d1 and d2 indicate where the restoring force of diaphragm 8 and the Coulomb force acting on the opposing electrode gap are balanced, dl being an unstable balance point and d2 being a stable balance point. More specifically, when a constant voltage is applied, diaphragm 8 displaces from G1 to d2 and stops. If external force is thereafter applied and diaphragm 8 displaces to a position between d2 and d1, diaphragm 8 will simply return to d2 again when that external force is released. However, if diaphragm 8 is displaced by an external force beyond d1 to a point near the electrode segment, diaphragm 8 will displace to the contact position, i.e., to G0, and this contact will be retained even after the external force is released.

A high voltage shown in FIG. 4 as curve (b) is applied to the opposing electrode gap to force diaphragm 8 with the gap length of G1 to contact the opposing wall. When this voltage is applied, there are no crossing points of curve (b) and the straight line passing G1, i.e., balance points d1 and d2, and diaphragm 8 is immediately displaced to the contact position G0. It is to be noted that displacement of diaphragm 8 can be forced to overshoot d1 by suddenly re-applying a voltage after applying a voltage lower than this high voltage if the distance between d1 and d2 is sufficiently small. It is therefore also possible to force diaphragm 8 to the contact position using a lower voltage.

In case of gap length G3, the voltage whose curve is denoted (d) in FIG. 4 is required for making diaphragm 8 to contact the opposing wall. This voltage is higher than that required for gap length G1. As described above, it is possible to make the drive voltages required for making diaphragm 8 to contact opposing wall 91 different from each other by using different gap length.

Figure 5:
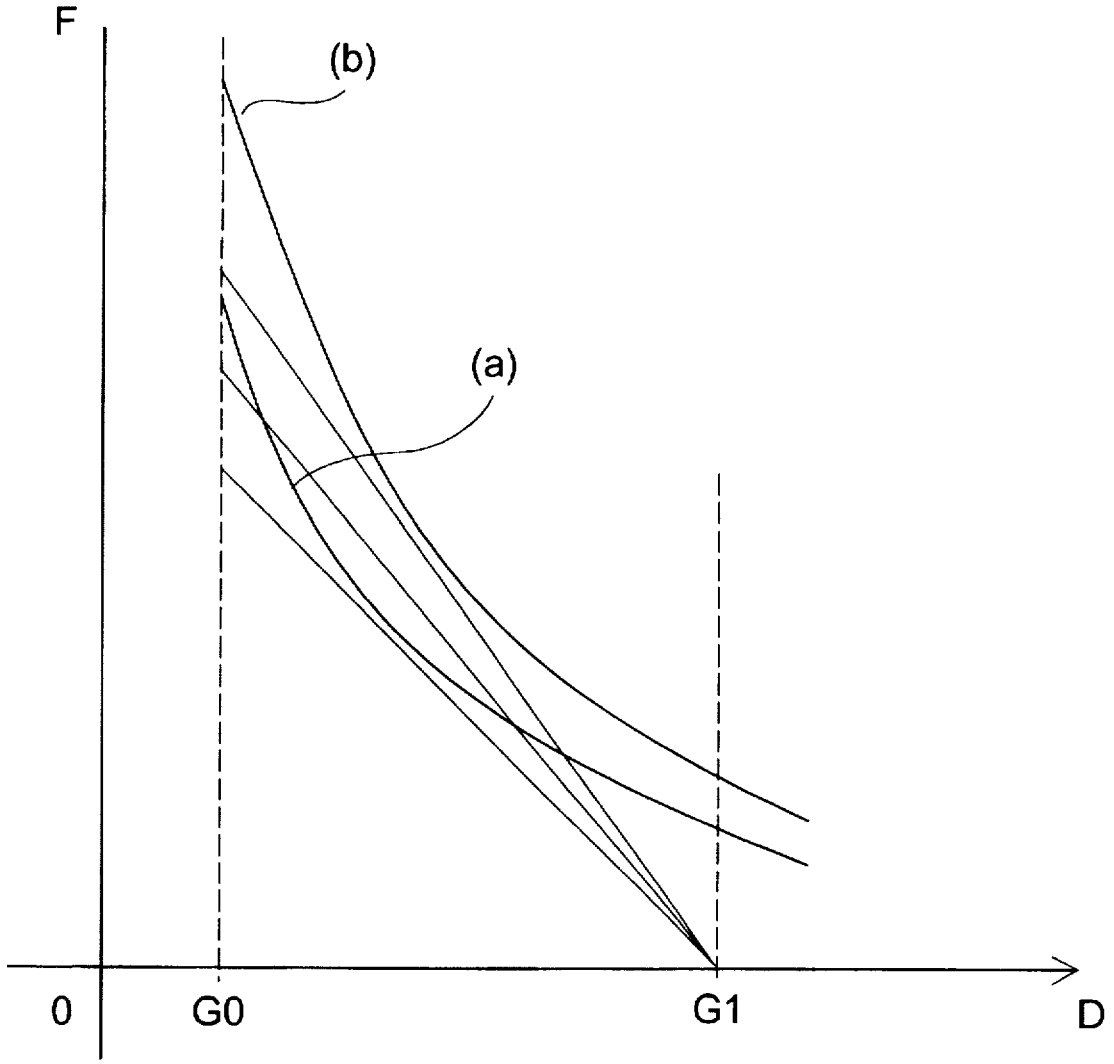
FIG. 5 is a graph showing the relationship between the distance from the electrode segment and the force acting on the diaphragm when the diaphragm is displaced.

Also, it is possible to make the drive voltage for diaphragm contacting different even if the gap length is maintained constant. FIG. 5 shows forces acting on the diaphragm of an example with the unique gap length of G1 and the diaphragm having plural sections with different compliance. The lower compliance section of the diaphragm, i.e., whose elastic force line is steep requires relatively high driving voltage for contacting corresponding to curve (b). In case of the higher compliance section of the diaphragm whose elastic force line is gentle, it is possible to make the section contact the opposing wall with lower driving voltage on the contrary. Accordingly, the higher the compliance of the diaphragm is, the lower the driving voltage for diaphragm contacting becomes if the gap length is constant.

To next return diaphragm 8 to the original position, the applied voltage is discharged or otherwise dropped to a low voltage as shown in FIG. 4, curve (c). This causes diaphragm 8 to begin moving toward the stable balance point d3 at a rate of acceleration determined by the difference between the diaphragm restoring force and the Coulomb force. As a result, if the applied voltage is dropped with sufficient speed, the restoring acceleration of diaphragm 8 will be sufficient to propel the ink drops. Likewise, if the applied voltage is lowered gradually, the restoring acceleration of diaphragm 8 can be suppressed to prevent ejecting any ink drops.

Diaphragm compliance

Because a volume change in the ink chamber is effected by deforming the diaphragm, the compliance of diaphragm 8 is defined here as the amount of volume change in the ink chamber resulting from unit pressure acting on the diaphragm 8.

Figure 6:
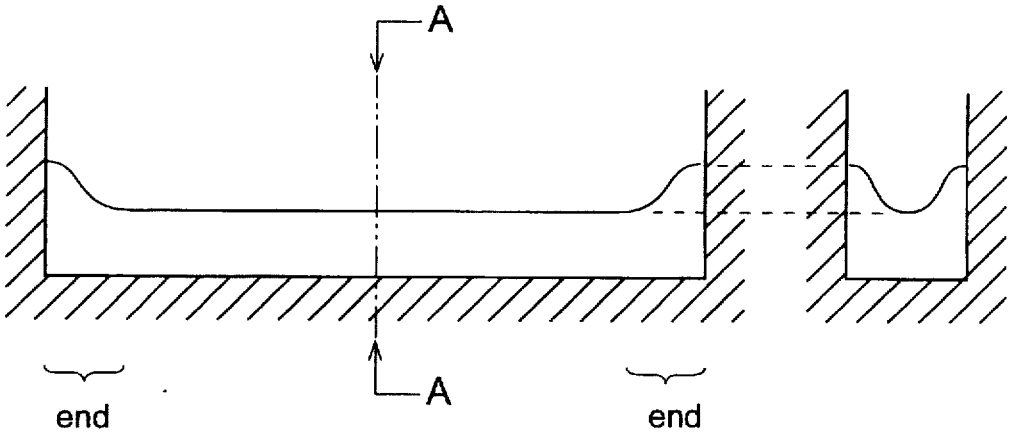
FIG. 6 illustrates the displacement of the diaphragm in an ink jet head according to the present invention.

Note that in order to narrow the ink nozzle pitch, diaphragm 8 is designed with the smallest possible dimension in the direction in which the ink nozzles are arrayed, i.e., in the up and down direction as seen in FIG. 2 (the diaphragm "width" hereafter), and a large dimension in the direction perpendicular to the width (hereafter, the diaphragm "length"), e.g., a 3 mm length for a 200 micrometer width in this example. As a result, the rigidity across the width of diaphragm 8, except at the ends in the lengthwise direction of diaphragm 8, determines the amount of deformation in diaphragm 8 when an equally distributed load (pressure or Coulomb force) acts on diaphragm 8 as shown in FIG. 6. The following relationship can therefore be defined between the shape and compliance (Cm) of diaphragm 8.

$$Cm=K*L*W^5/T^3$$

where K is a constant, and L, W, and T are the length, width, and thickness, respectively, of diaphragm 8. As this equation shows, the compliance (Cm) of diaphragm 8 is proportional to the length (L), proportional to the fifth power of the width, and inversely proportional to the cube of the thickness (T), of diaphragm 8.

It will also be obvious that the compliance of diaphragm 8, when diaphragm 8 is in contact with the opposing wall, can be considered equal to zero. This is because even if only a third of the width in the center of diaphragm 8 contacts the opposing wall, the compliance will be less than 1/100th because compliance is proportional to the fifth power of the width.

The preferred embodiments of the present invention are therefore described hereinbelow against this background.

EMBODIMENT 1

In the first embodiment, compliance varies in different parts of the diaphragm.

The first embodiment of the present invention is described below with reference again to FIG. 1. Diaphragm 8 in this embodiment comprises a thin-wall member 8*a* and a thick-wall member 8*b* at different parts in the lengthwise direction of pressure generating chamber 5 (also referred to as ink chamber 5). When the applied voltage is released and the voltage is discharged after diaphragm 8 contacts the opposing wall, the Coulomb force dissipates and diaphragm 8 is returned by the elastic energy of the diaphragm material. The elastic energy of thick-wall member 8*b* is greater than that of thin-wall member 8*a*. Thick-wall member 8*b* therefore responds faster than does thin-wall member 8*a*, thus rapidly shrinking the capacity of ink chamber 5 and generating a high ink pressure.

The elastic energy stored in thin-wall member 8*a* is weak, and thin-wall member 8*a* thus attempts to return gradually. The ink pressure generated by the return of thick-wall member 8*b*, however, hinders the return of thin-wall member 8*a*, which thus remains in contact with the opposing wall. The compliance of thin-wall member 8*a* when in contact with the opposing wall is therefore extremely low. The rigidity of ink chamber 5 during ink droplet ejection is thus high (i.e., compliance is low) and a high ink pressure results, causing the ink droplet to be ejected at a high speed.

After the ink pressure in ink chamber 5 becomes rapidly high and the ink droplet is ejected, the ink pressure drops rapidly in response to the movement of the thick-wall member 8*b* of the diaphragm. When the pressure drops to a predetermined level, the thin-wall member 8*a* of the diaphragm moves away from the opposing wall. Because the compliance of the thin-wall member 8*a* of diaphragm 8 is high when thin-wall member 8*a* is separated from the opposing wall, vibrations in the ink flow are buffered, and vibration in the meniscus of the nozzle after ink droplet ejection is minimized.

Any subsequent vibration in the ink flow is then gradually buffered by the viscosity resistance of the ink and the flow resistance of the ink supply path. Because thin-wall member 8*a* absorbs pressure in ink chamber 5 and vibrates without contacting the opposing wall, it is also able to suppress satellite emissions. It is therefore not necessary to increase the ink viscosity or flow resistance of the ink supply path, making it possible to shorten the time required to induct ink to the ink chamber and the time interval to eject the next ink droplet. More specifically, it is possible to increase the frequency of ink droplet ejection.

The thickness of diaphragm 8 and the gap to the opposing wall must be appropriately set for the pressure generated in ink chamber 5 during ink droplet ejection to force thin-wall member 8*a* in contact with the opposing wall. This is described below assuming, by way of example only, the disposition of the ink chambers at a density of 90 chambers per inch.

It is further assumed that the ink chambers are 200 pm wide, 3 mm long, 3 pm thick and 0.8 mm long in the thin-wall member, 5 pm thick and 2.2 mm long in the thick-wall member, and have a 1 pm gap between bottom wall 8 and the opposing wall (insulation layer 15). The thin-wall member in this case contacts the opposing wall at a pressure of approximately one atmosphere. Because compliance is inversely proportional to the cube of the diaphragm thickness and proportional to the length, the compliance ratio between thin- and thick-wall members is approximately 2:1. Thus, when the thin-wall member contacts the opposing wall, compliance drops to approximately 1/3, and the specific vibration frequency of the ink is shortened 40%. In other words, ink chamber 5 becomes approximately three times softer (i.e., more pliant) after ink droplet ejection compared with when the ink droplet is being ejected. Thus, high speed ink droplet ejection can be achieved, and vibration of the ink nozzle meniscus can be sufficiently suppressed.

It should also be noted that the diaphragm is doped with boron (B) in this embodiment so that diaphragm 8 can be used as one of the opposing electrodes. Because the etching rate is also determined by the boron concentration, parts of various thicknesses can be easily formed in the diaphragm by controlling boron doping. This can be achieved by using a mask to control the diffusion of boron from the back of silicon substrate 2 during doping, varying the depth of the high concentration boron layer. The deep, high concentration boron region is etched more slowly and is therefore left when etching is stopped, thus forming a diaphragm with members of different thicknesses.

Figure 7:
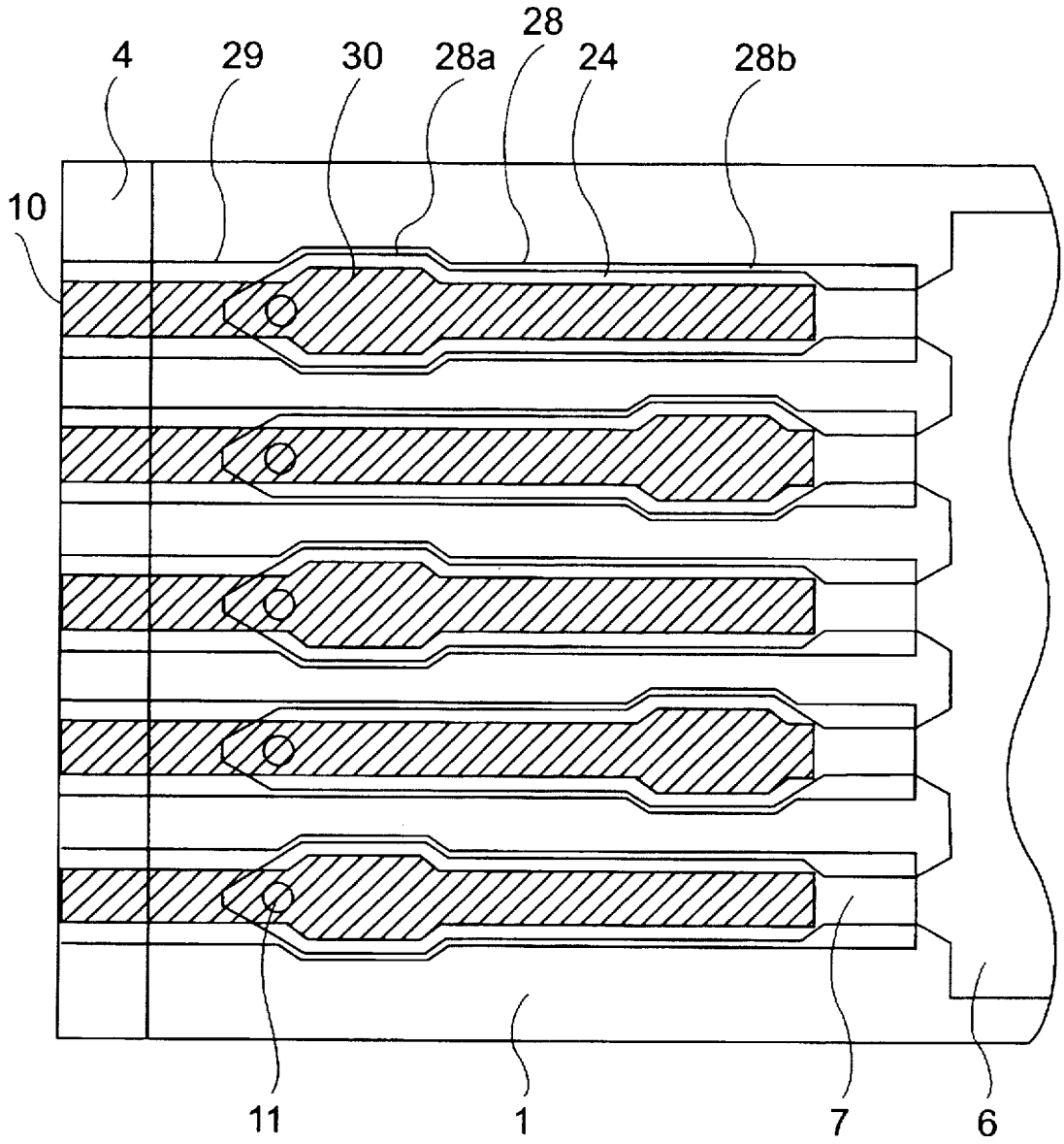
FIG. 7 is a plan view of a preferred embodiment of an ink jet head according to the present invention.

An alternative embodiment of the first embodiment above is described next with reference to the plan view of an ink jet head shown in FIG. 7. One part of ink chamber 24 is wider than the rest of ink chamber 24 in this embodiment. Recesses 29 in glass substrate 4 are similarly formed with wide members matching ink chambers 24. The width of diaphragm 28 is also increased in this area (forming wide members 28*a*). Wide members 28*a* are also formed at offset positions in the lengthwise direction of adjacent ink chambers 24 as a means of achieving a high density array of ink chambers 24.

The compliance of the diaphragm is still proportional to the fifth power of the width as described above. The compliance of these wide members 28*a* is therefore greater than that of the other members 28*b*. The width of wide members 28*a* in this embodiment is 1.3 times the width of the other members 28*b*, imparting 1/12 of the compliance of ink chamber 24 to the wide member 28*a*. As a result, when this wide member 28*a* contacts the opposing wall, the compliance of pressure generating chamber 24 (also referred to as ink chamber 24) is ½, and the ink flow response during ink droplet ejection can be increased. A wide member 30 is also formed in electrode segment 10 corresponding to wide member 28*a* of the diaphragm, making it possible to force wide member 28*a* in contact with the opposing wall by applying a lower voltage.

When a voltage is applied by drive circuit 21 between electrode segment 10 and diaphragm 8 in the first embodiment above, the high compliance part of the diaphragm (thin-wall member 8*a* or wide member 28*a*) deflects more easily than the other parts (thick-wall member 8*b* or other members 28*b*) of the diaphragm, and can be forced to contact the opposing wall by applying a lower voltage. When a voltage is applied causing the high compliance part 8*a* or 28*a* to deflect and contact the opposing wall, the interfacial area to the low compliance thick-wall member 8*b* or other member 28*b* is also attracted to the opposing wall, passing the unstable balance point, and contacting the opposing wall.

This action is propagated across the diaphragm. As a result, the entire diaphragm can be caused to contact the opposing wall with a significantly lower voltage than would be required if a high compliance member was not provided.

This means that when the same drive voltage is used, the compliance of the diaphragm contributing to ink droplet ejection can be reduced. This is also advantageous for achieving a high ink nozzle density. Specifically, the width of the diaphragm, i.e., the bottom wall of ink chamber 5, must be reduced in order to increase the nozzle density of the ink jet head. Compliance is thus reduced because it is proportional to the fifth power of the width as described above.

Figure 8:
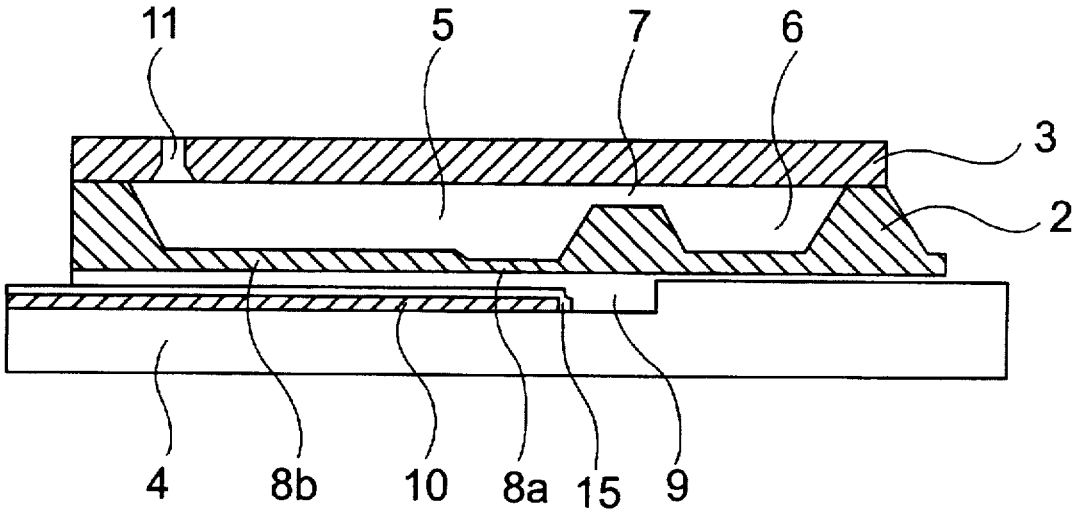
FIG. 8 is a simplified side cross-sectional view of an ink jet head according to the present invention.

Other variations as described below are also possible because the diaphragm deforms gradually and contacts the opposing wall from the low compliance part thereof. FIG. 8 is a side cross section of an ink jet head according to a first alternative embodiment. In this embodiment a low rigidity thin-wall member 8*a* is formed on the ink supply path 7 side of ink chamber 5. Elastic displacement of diaphragm 8 thus occurs from the ink supply side of ink chamber 5, i.e., the end closest to the ink supply path. This elastic displacement is propagated toward the nozzle end of the ink chamber. Elastic displacement of diaphragm 8 occurs in order to start an ink flow from ink supply path 7 toward ink nozzle 11, i.e., in the direction supplying ink to ink chamber 5. Ink supply can thus be accomplished quickly, and the ink ejection frequency can be increased.

EMBODIMENT 2

Gap between the diaphragm and opposing wall

The second embodiment of the present invention is described next with reference to FIG. 9. The gap G between diaphragm 51 and opposing wall 91 in this embodiment is described first.

As shown in FIG. 9, the back of each diaphragm 51 is flat while opposing wall 91 formed on the surface of glass substrate 4 is formed in a stepped pattern descending lengthwise relative to ink chamber 5. This stepped pattern results in plural gaps of different dimensions between glass substrate 4 and diaphragm 51. The smallest gap G1 is formed at the end of ink chamber 5 nearest ink supply path 7, i.e., between the diaphragm and the first step of opposing wall 91. Adjacent to gap G1 in the middle of diaphragm 51 is formed a second gap G2 greater than gap G1. The third gap G3 formed closest to ink nozzle 11 is the greatest gap between opposing wall 91 and diaphragm 51. These gaps are, more accurately, the electrical gaps defined by the distance from the top surface of electrode segment 10 and the bottom of diaphragm 51 as shown in FIG. 3. The corresponding mechanical gaps are defined as these electrical gaps minus the thickness G0 of the insulation layer 15.

As described above, the gap G between diaphragm 51 and opposing wall 91 is formed sequentially along the length of the ink chamber such that the smallest gap G1, the intermediate gap G2, and the greatest gap G3 are formed in sequence from the ink supply path end to the ink nozzle end of ink chamber 5. As a result, by increasing or decreasing the number of parts of diaphragm 51 held in contact with the opposing wall during ink droplet ejection, the compliance of the ink chamber during ink droplet ejection can be changed. Thus, the specific vibration frequency of the ink oscillation path can be variably controlled. This also means that the volume of the ejected ink droplet can be adjusted. In general, the higher the specific vibration frequency of the ink vibration path, the finer the ejected ink droplets can be made; and the smaller the displacement volume of the diaphragm, the smaller the volume of the ejected ink droplets.

For example, if parts 51*b* and 51*c* of diaphragm 51 are driven while holding diaphragm part 51a at the smallest gap G1 in contact with opposing wall 91, compliance is reduced by an amount corresponding to the length of part 51*a* contacting opposing wall 91 because the compliance is proportional to the working length of the diaphragm. The specific vibration period of the ink vibration path is thus shortened compared with when the entire length of the diaphragm vibrates, and finer ink droplets can be ejected at high speed.

Figure 11:
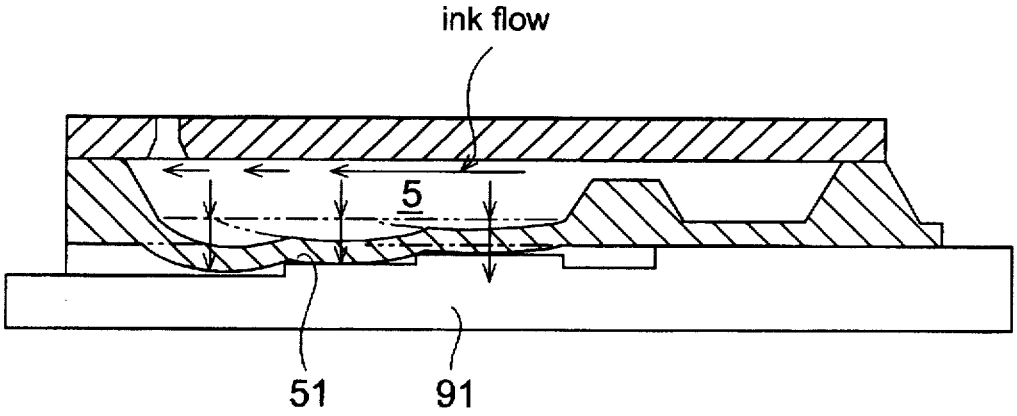
FIG. 11 illustrates the operation of the ink jet head according to the second embodiment of the present invention shown in FIG. 9.

In addition, if a part with a small gap G1 is formed, the corresponding part 51*a* of diaphragm 51 can be easily attracted to opposing wall 91 by applying a noticeably smaller drive voltage than is required with a larger gap. When a partially deflected state is thus formed, this point of partial deflection (i.e., partial contact between the diaphragm and the opposing wall) acts as the starting point for the gradual propagation of elastic displacement across the complete diaphragm as shown in FIG. 11 This is because the other parts of the diaphragm are pulled by part 51*a* past the unstable balance point, and are displaced until they contact the opposing wall. It is therefore possible to drive an ink jet head thus comprised using a lower voltage than is required when a small gap G1 is not formed. As a result, a high ink nozzle density can be easily achieved for the same reasons as described above in the first embodiment.

It is to be noted that these gaps are formed in this embodiment by increasing in size from the ink supply path end to the ink nozzle end of ink chamber 5. Displacement of the diaphragm thus progresses from the ink supply path toward the ink nozzle as shown in FIG. 11. A smooth supply of ink can therefore be achieved, and the ink eject frequency can be increased, for the same reasons as described above in the first embodiment.

It will also be apparent that while the present embodiment has been described forming gap G in three stages (large, medium, and small gaps), it is also possible to form only a two stage gap, or to form four or more stages. The gap shall also not be limited to a stepped configuration with a finite number of different gaps as described above, and a continuously variable range of gaps can also be formed using a smooth curved or sloping surface. Ink jet head drive circuit A drive circuit suitable as voltage application means 21 (shown in FIG. 2) used to apply a voltage and thus drive an ink jet head constructed as described above is described below with reference to FIG. 12, which shows a circuit diagram of the drive circuit, and FIG. 13A–13E, which shows a timing chart of drive circuit operation. While the circuit shown in FIG. 12 is a preferred circuit, as would be appreciated by one of ordinary skills in the art, other circuit designs may be utilized.

Figure 12:
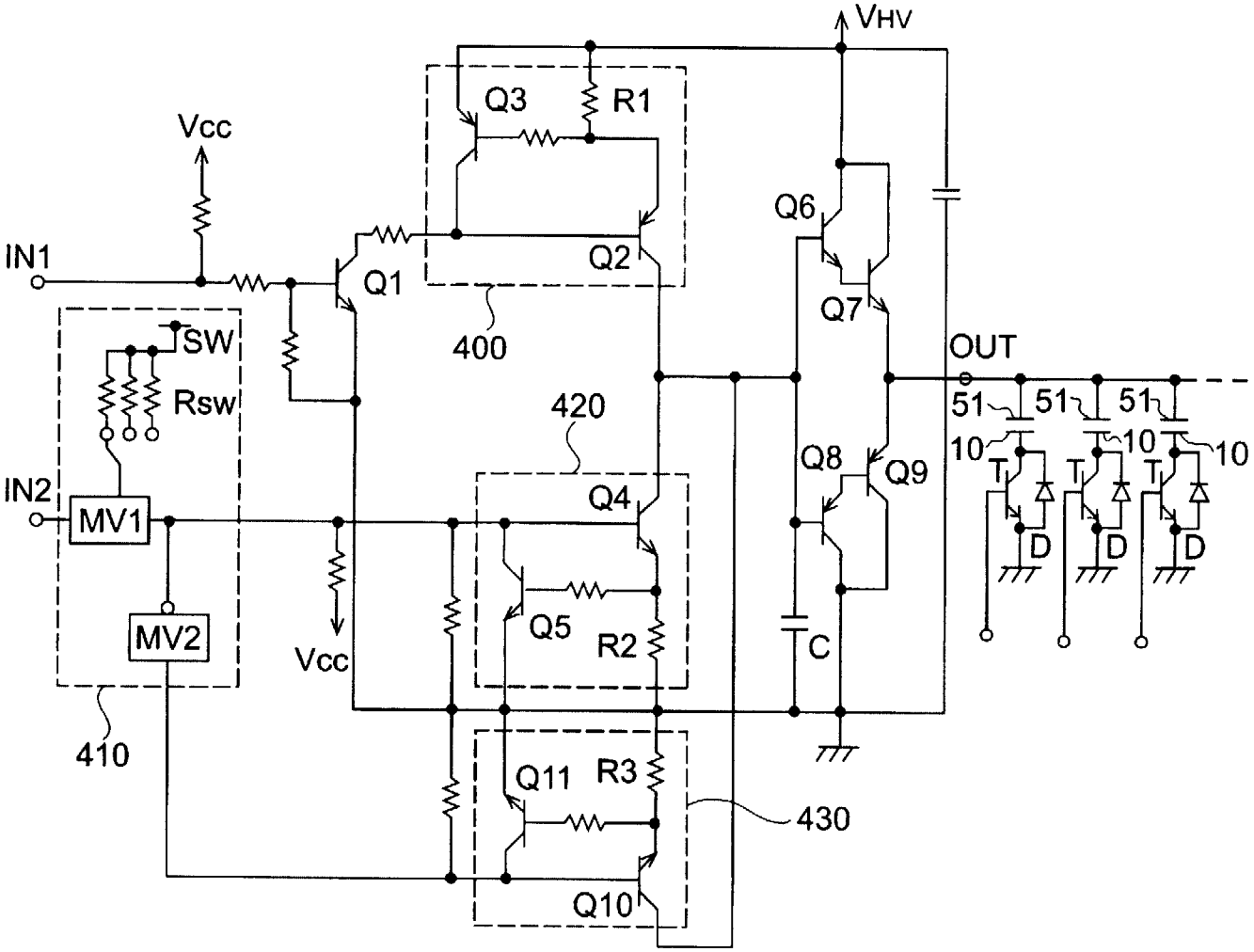
FIG. 12 is a circuit diagram of one example of a drive circuit for an ink jet head according to the second embodiment of the present invention shown in FIG. 9.

Charge signal IN1 in FIG. 12 is used to accumulate a charge between the opposing electrodes (diaphragm 51 and electrode segment 10) to displace diaphragm 51, and is input through level-shift transistor Q1 to first current source circuit 400. First current source circuit 400 comprises primarily transistors Q2 and Q3, and resistor R1, and charges capacitor C with a constant current value.

Discharge signal IN2 is used to discharge the charge stored to the charged opposing electrodes, and thus restore diaphragm 51 to the standby (non-displaced) state.

Eject volume control circuit 410 comprises first and second one-shot multivibrators MV1 and MV2. First one-shot multivibrator MV1 outputs a signal of pulse width Tx when discharge signal IN2 is input. Pulse width Tx output by first one-shot multivibrator MV1 may be one of three different pulse widths selectable by the ink eject control signal in this embodiment. More specifically, the time constant of the time constant circuit which determines the output pulse width of the one-shot multivibrator MV1 is changed by switching with a resistance switcher SW the connected resistances $R_{sw}$. Note that resistance switcher SW can be easily achieved using transistors and other various known switching circuit technologies.

Second one-shot multivibrator MV2 outputs a signal of pulse width Td synchronized to the trailing edge of the pulse output from first one-shot multivibrator MV1.

The output of first one-shot multivibrator MV1 is input to a second current source circuit 420, and the output of second one-shot multivibrator MV2 is input to a third current source circuit 430. Second current source circuit 420 comprises primarily transistors Q4 and Q5, and resistor R2, and whose purpose is to discharge the charge stored to capacitor C at a constant rate during period Tx based on the signal input from first one-shot multivibrator MV1.

Third current source circuit 430 comprises primarily transistors Q10 and Q11, and resistor R3, the resistance of which is greater than that of resistor R2. Third current source circuit 430 is comprised to discharge the charge stored to capacitor C at a constant rate that is slower than the discharge rate of second current source circuit 420 during period Td based on the signal input from second one-shot multivibrator MV2.

The terminals of capacitor C are connected to the output terminal OUT via a buffer comprising transistors Q6, Q7, Q8, and Q9. The common electrode terminal 22 (FIG. 2) of the ink jet head is also connected to the output terminal OUT, and the output of transistor T is connected to the respective electrode segment 10 (FIG. 2).

While charge signal IN1 is active, capacitor C is charged to a constant current level. If the transistor T corresponding to the electrode segment of the nozzle from which a droplet is to be ejected is also on at this time, the corresponding opposing electrode gap will be charged to the same voltage level as the capacitor C. Because the capacitor C is discharged when the discharge signal is input, the charge stored to the charged electrode gap is also discharged through the corresponding diode D.

The operation of a drive circuit thus comprised is described further below with reference to the timing chart in FIG. 13. When charge signal IN1, as shown in FIG. 13A, becomes active, the leading edge of the charge signal turns level-shift transistor Q1 and transistor Q2 of first rated current circuit 400 sequentially on. Capacitor C is thus charged using a constant current value determined by resistor R1.

Figures 13A, 13B, 13C, 13D, 13E:
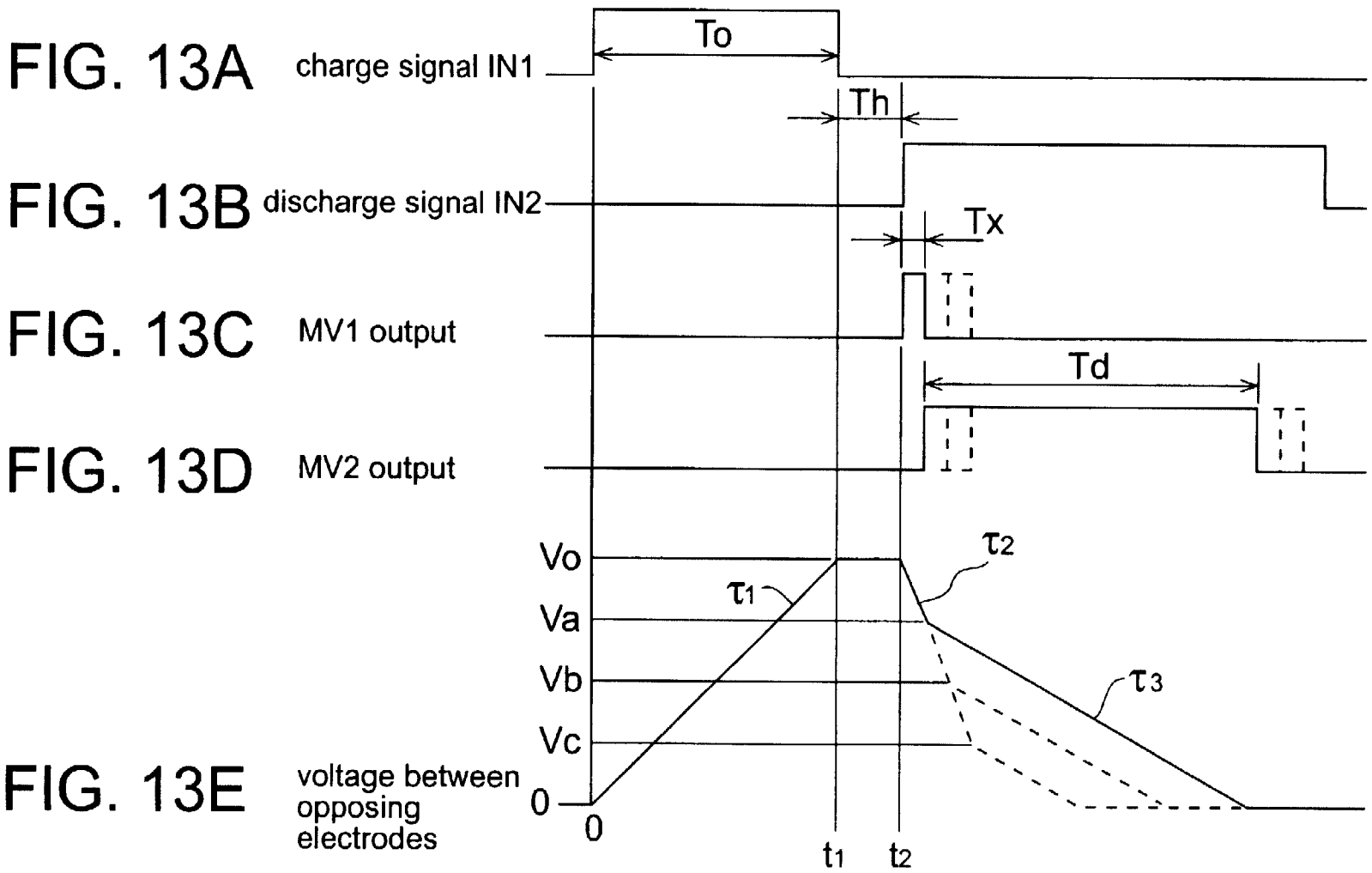
FIGS. 13A–13E are signal timing charts for illustrating the operation of the drive circuit shown in FIG. 12.

The terminal voltage of capacitor C thus rises linearly from 0 volt with a constant slope $\tau_1$ as shown in FIG. 13C, during the period to time τ1 (FIG. 13E). This slope $\tau_1$ is determined by the resistance of resistor R1, or the electrostatic capacity of capacitor C. Thus, by increasing the resistance of resistor R1, the charge rate of capacitor C and the opposing electrodes connected thereto through the buffer can be set low. This charge rate is determined with consideration given to, for example, the ink supply rate to the ink chamber. Ink thus flows from common ink chamber 6 into ink chamber 5 through the ink supply path because diaphragm 51 is displaced toward electrode segment 10, and ink chamber 5 expands.

When charge signal IN1 becomes inactive after time T0 has passed (at time τ1), transistors Q1 and Q2 become off and charging capacitor C thus stops. The voltage corresponding to the charge stored to the opposing electrode gap is thus held at voltage V0 at time τ1, and diaphragm 51 stops in contact with electrode segment 10 via insulation layer 15.

When a predetermined period Th then passes, discharge signal IN2 becomes active (FIG. 13B). Transistor Q4 of second rated current circuit 420 is thus turned on by the signal (FIG. 13C) output from first one-shot multivibrator MV1 in eject volume control circuit 410, and the charge stored to capacitor C is discharged during period Tx at a rate determined by resistor R2. The voltage between the terminals of capacitor C thus drops linearly with slope $\tau_2$ based on the resistance of resistor R2.

When a period determined by the output pulse width Tx of first one-shot multivibrator MV1 passes, transistor Q4 becomes off, and discharging by second rated current circuit 420 stops. At the same time, transistor Q10 in third rated current circuit 430 is turned on by the signal (FIG. 13D) from second one-shot multivibrator MV2 in eject volume control circuit 410, and discharging the charge held in capacitor C begins again, this time through resistor R3.

The resistance of resistor R3 is greater than the resistance of resistor R2, and the voltage between the terminals of capacitor C thus drops linearly but on a more gradual slope $\tau_3$ (i.e., at a slower rate).

Note that the pulse width Td of the signal output from second one-shot multivibrator MV2 is set with consideration given to both the ink ejection frequency and the time needed to completely discharge the charge between the opposing electrodes.

Inkjet head drive method

Figure 14:
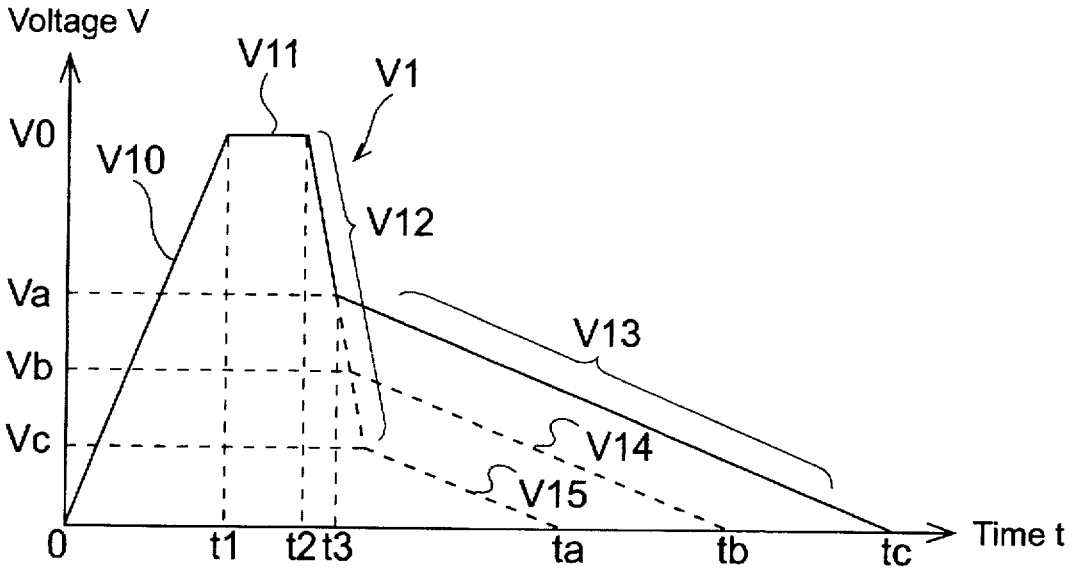
FIG. 14 is a waveform diagram showing the voltage waves between the opposing electrodes for illustrating the operation of a drive method for an ink jet head according to the second embodiment of the present invention shown in FIG. 9.

The drive method for the ink jet head described above is described next below with reference to FIGS. 14 and 15. FIG. 14 shows one example of the voltage waveform between the opposing electrodes. The opposing electrode gap is charged so that the gap voltage V10 rises to a peak voltage V0 at time τ1, and the peak voltage V0 (V11) is then held until time τ2. The gap voltage is then decreased as described below to eject ink.

The discharge process of the charge stored to the opposing electrode gap (the "gap charge" below) is divided into two periods: a first period V12 in which the slope of the voltage drop relative to time is steep, and a second period continuing from the first period but with a more gradual slope to the voltage drop curve. Specifically, discharging begins at time τ2 following a known period from time τ1 during which the gap charge is held at the peak voltage V0. The gap charge thus drops to voltage Va at time τ3 following the rapid voltage drop curve of the first discharge period V12, and then drops to zero from time τ3 following the more gradual voltage drop curve of the second period V13.

It should be noted that the voltage drop target value of the first period V12 can be varied by drive circuit 21 of this embodiment between voltages Va, Vb, and Vc, for example, as shown in FIG. 14. This can be specifically achieved by selecting the output pulse width of first one-shot multivibrator MV1 described above. For example, if the voltage drop target value is selected as voltage Vb or Vc, the voltage drops first to the selected target voltage and then to zero during period V14 or V15 at the same discharge rate used in period V13.

Diaphragm 51 operates as described below when the gap charge is discharged in the first period V12 to Va at time τ3, and then from time τ3 to 0 V following the more gradual discharge slope of period V13. While the gap charge drops to voltage Va, part 51*c* of diaphragm 51 where the electrode gap G3 is greatest separates from surface 91*a* of opposing wall 91 first, and is elastically displaced toward the inside of ink chamber 5.

Figure 15:
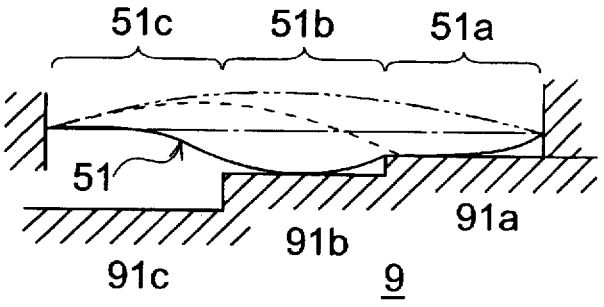
FIG. 15 illustrates the elastic displacement of the diaphragm in an ink jet head according to the second embodiment of the present invention shown in FIG. 9.

This elastic displacement of diaphragm 51 is shown by the solid line in FIG. 15. As the voltage continues to drop gradually from this point, part 51*b* (at intermediate gap G2) and part 51*a* (at the narrowest gap G1) are separated sequentially from opposing wall 91, and are displaced into ink chamber 5 by their inherent elastic restoring force. When these parts 51*b* and 51*a* separate from opposing wall 91, however, ink droplet ejection is already completed. As a result, ink droplet ejection is effectively accomplished by the ink pressure generated inside ink chamber 5 by the elastic restoring energy of diaphragm part 51*c* disposed to the largest gap G3. During ink droplet ejection part 51*b* at intermediate gap G2, and part 51*a* at the smallest gap G1, respectively contact surfaces 91*b* and 91*a* of opposing wall 91, and the compliance of the ink vibration system is thus low. The specific vibration period can therefore be shortened, and fine ink droplets can be ejected at high speed. After ink droplet ejecting, parts 51*b* and 51*a* of the diaphragm separate from opposing wall 91, and the compliance of the ink oscillation system is increased. Satellite emissions resulting from vibration of the ink are thus prevented as described in the first embodiment above.

When the gap charge drops to voltage Vb at the slope of first period V12, and then drops gradually to zero on slope V14, parts 51*c* and 51*b* of diaphragm 51 corresponding to the large and intermediate gaps G3 and G2, respectively, separate nearly simultaneously from parts 91*c* and 91*b* of the opposing wall, and are displaced into ink chamber 5 by the elastic restoring force to eject ink from the nozzle. In this case, part 51*a* of diaphragm 51 corresponding to the smallest gap G1 remains in contact with surface 91*a* of opposing wall 91, and does not contribute to ink ejecting. The compliance of the ink oscillation system during ink ejecting is thus greater than during the ink ejection operation achieved by only part 51*c* of the diaphragm (shown by the solid line in FIG. 15). The amount of ink ejected is also greater because a greater proportion of the diaphragm displacement contributes to ink ejection causing the vibration frequency to be lowered.

If the gap charge is discharged rapidly to voltage Vc, all of diaphragm 51 is elastically displaced into the ink chamber by the elastic restoring force as shown by the droplet-droplet-dash line in FIG. 15, and contributes to ink droplet ejection. No part of the diaphragm remains in contact with opposing wall 91 in this case, compliance is greatest, and a large ink droplet can therefore be ejected.

It is therefore possible to change the ink droplet ejection characteristics, particularly the ink droplet speed and size, of ink nozzle 11 by changing the voltage drop characteristics when discharging the gap charge, i.e., by changing the discharge rate.

EMBODIMENT 3

Figure 16:
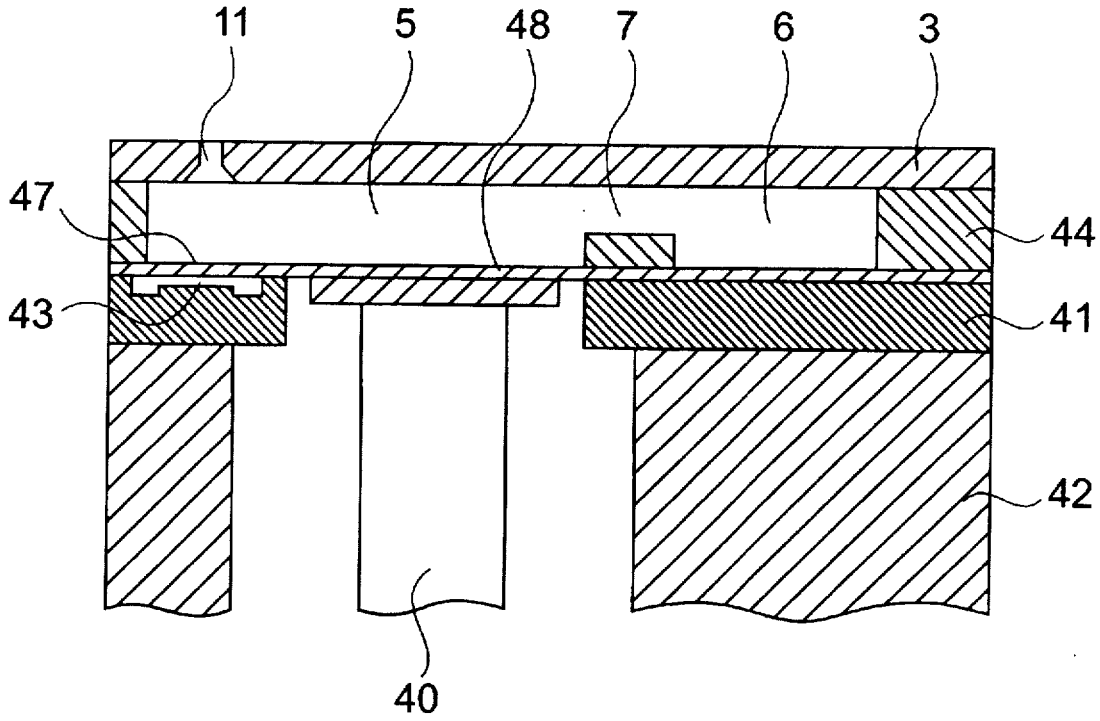
FIG. 16 is a simplified cross-sectional view showing an ink jet head according to a third embodiment of the present invention taken along line 16—16 of FIG. 17.
Figure 17:
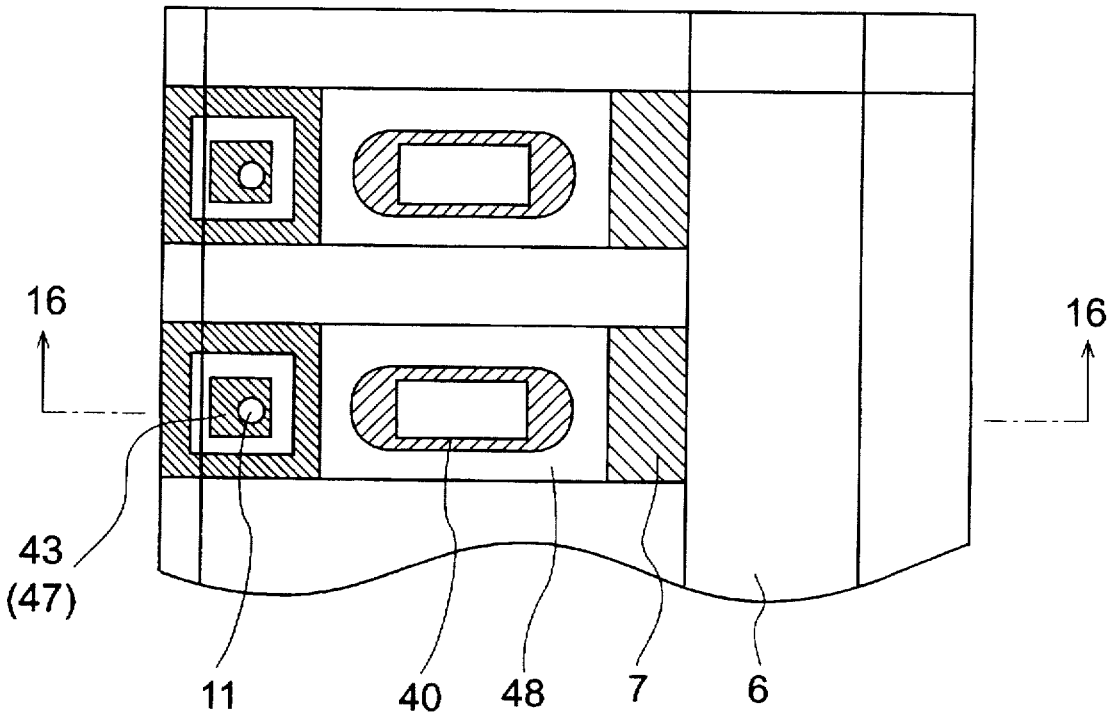
FIG. 17 is a plan view of the embodiment of the ink jet head shown in FIG. 16.

FIG. 16 is a cross-sectional view of ink chamber 5 taken along line 16—16 of FIG. 17, which shows a plan view FIG. 16. A flow path pattern connecting common ink chamber 6, ink supply path 7, and ink chamber 5 is formed in flow path substrate 44. This side of flow path substrate 44 is then covered by nozzle plate 3, and the other side is sealed by diaphragm 48, to form the flow path. Nozzles 11 are formed in nozzle plate 3, and are open to ink chamber 5.

A long, narrow piezoelectric element 40 is connected to diaphragm 48, which is the bottom wall of ink chamber 5, and the other end of piezoelectric element 40 is fixed to frame 42. When voltage is applied to piezoelectric element 40, piezoelectric element 40 contracts in the long direction on the fixed base thereof, i.e., perpendicularly to diaphragm 48 (vertically as seen in FIG. 16), and is thus used to increase or decrease the capacity of ink chamber 5.

The pressure generating means of piezoelectric element 40 is capable of generating a strong force, and can thus eject ink at high speed. An elastic wall 47 that is deformed by the ink pressure is disposed to ink chamber 5 to prevent ejecting unnecessary ink droplets by the residual vibration of the ink flow after ink ejection. When such an elastic wall is provided, however, the drive force produced by piezoelectric element 40 is absorbed by elastic wall 47. The ink droplet ejecting speed drops, resulting in a low drive efficiency ink jet head.

The ink jet head of the present invention resolves this problem by forming contact 43 at a position opposing elastic wall 47 formed in the end of ink chamber 5 with a suitable gap between contact 43 and elastic wall 47. Contact 43 is formed by forming a land surrounded by a deep channel in the surface of fixed substrate 41 opposing elastic wall 47; the gap to elastic wall 47 is formed and dimensionally controlled by slightly recessing the top of contact 43 from the surface of fixed substrate 41. The channel around contact 43 also functions to prevent the adhesive used to bond diaphragm 48 (including elastic wall 47) to fixed substrate 41 from flowing into this gap.

As a result of this construction, elastic wall 47 is not greatly displaced by the high positive pressure generated during ink droplet ejection because it contacts the opposing wall (contact 43). Elastic wall 47 thus functions to help drive the ink droplet under high pressure during ink droplet ejection. After ink droplet ejection, elastic wall 47 is displaced proportionally to the resulting low positive pressure or negative pressure, and thus functions, after ink droplet ejection, to buffer the rapid pressure change and prevent satellite emissions.

While the invention has been described in conjunction with several specific embodiments, it is evident to those skilled in the art that may further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A printing apparatus, comprising:

an ink jet head;

a circuit applying a drive voltage to said ink jet head; and wherein said ink jet head comprises at least one ink jet head unit comprising:

a nozzle, a pressure chamber having an opening in communication with said nozzle and a diaphragm forming one wall of said chamber, an electrostatic actuator, including an electrode disposed in an opposing wall externally to said pressure chamber and opposite to said diaphragm, and responsive to said drive voltage for elastically displacing said diaphragm according to said drive voltage, said diaphragm comprising a plurality of contiguous segments, at least one of said segments having a greater compliance than at least one other of said segments, said at least one greater compliance segment for absorbing pressure resulting from ink vibration in said pressure chamber, said at least one greater compliance segment contacting said opposing wall by a level of said drive voltage lower than that required by said at least one other segment whereby said opposing wall limits pressure absorption by said at least one greater compliance segment.

2. An ink jet head comprising:

a nozzle;

a pressure chamber having an opening in communication with said nozzle and a diaphragm forming one wall of said chamber;

an electrostatic actuator including an electrode disposed in an opposing wall externally to said pressure chamber and opposite to said diaphragm, and a circuit for applying a drive voltage between said electrode and said diaphragm for elastically displacing said diaphragm according to said drive voltage;

said diaphragm comprising a plurality of N contiguous segments, and said opposing wall having stepped configuration such that N gaps are formed in diminishing size between said N segments of said diaphragm and said opposing wall;

at least one of said N segments being separated from said opposing wall by a smaller one of said gaps, said at least one segment for absorbing pressure from ink vibration in said pressure chamber; and said at least one segment contacting said opposing wall by a level of said drive voltage lower than that required by at least one other segment whereby said opposing wall limits pressure absorption by said at least one segment.

3. A printing apparatus comprising:

an ink jet head;

a circuit applying a drive voltage to said ink jet head; and wherein said ink jet head comprises at least one ink jet head unit comprising:

a nozzle, a pressure chamber having an opening in communication with said nozzle and a diaphragm forming one wall of said chamber, an electrostatic actuator including an electrode disposed in an opposing wall externally to said pressure chamber and opposite to said diaphragm, and responsive to said drive voltage for elastically displacing said diaphragm according to said drive voltage, said diaphragm comprising a plurality of N contiguous segments, and said opposing wall having a stepped configuration such that N gaps are formed in diminishing size between said N segments of said diaphragm and said opposing wall, at least one of said N segments being separated from said opposing wall by a smaller one of said gaps, said at least one segment for absorbing pressure from ink vibration in said pressure chamber, and said at least one segment contacting said opposing wall by a level of said drive voltage lower than that required by at least one other segment whereby said opposing wall limits pressure absorption by said at least one segment.

4. A printing apparatus comprising:

an ink jet head;

a circuit applying a drive voltage to said ink jet head; and wherein said ink jet head comprises at least one ink jet head unit comprising:

a nozzle, a pressure chamber having an opening in communication with said nozzle and a diaphragm forming one wall of said chamber, an electrostatic actuator including an electrode disposed in an opposing wall externally to said pressure chamber and opposite to said diaphragm, and responsive to said drive voltage for elastically displacing said diaphragm according to said drive voltage, said diaphragm comprising a plurality of N contiguous segments, and said opposing wall having a stepped configuration such that N gaps are formed in diminishing size between said N segments of said diaphragm and said opposing wall; and wherein said circuit applies different drive voltages to said electrostatic actuator at different times, said different drive voltages including:

a first drive voltage capable of forcing all of said N segments of said diaphragm to contact said opposing wall, a second drive voltage capable of maintaining contact between at least one of said N segments of said diaphragm and said opposing wall with other segments of said diaphragm being released, a third drive voltage capable of releasing contact between all of said N segments of said diaphragm and said opposing wall, and a group of drive voltages capable of maintaining contact between only selected ones of said N segments of said diaphragm and said opposing wall.

5. A printing apparatus according to claim 4, wherein said circuit comprises:

a charging circuit for charging said electrostatic actuator to at least the first drive voltage, a first discharge circuit for discharging, at a first discharge rate, said electrostatic actuator to a first selected voltage in the group of voltages, and a second discharge circuit for discharging, at a second discharge rate, said electrostatic actuator from a second selected voltage in the group of voltages, wherein the second discharge rate is slower than the first discharge rate.

6. A control method for use in a printing apparatus that comprises an ink jet head and a circuit for applying a drive voltage to said ink jet head, wherein the ink jet head comprises a nozzle, a pressure chamber having an opening in communication with said nozzle and a diaphragm forming one wall of said chamber, an electrostatic actuator including an electrode disposed in an opposing wall externally to said pressure chamber and opposite to said diaphragm, and responsive to said drive voltage for elastically displacing said diaphragm according to said drive voltage, said diaphragm comprising a plurality of N contiguous segments, and said opposing wall having a stepped configuration such that N gaps are formed in diminishing size between said N segments of said diaphragm and said opposing wall, the control method comprising the steps of:

(a) applying a first drive voltage to the electrostatic actuator so that all of the N segments of the diaphragm contact the opposing wall;

(b) after a first predetermined time has passed after said step (a), applying a second drive voltage to the electrostatic actuator for maintaining contact between at least one, but less than all of the N segments of the diaphragm and the opposing wall with remaining segments of the diaphragm being out of contact; and (c) after a second predetermined time has passed after said step (b), applying a third drive voltage to the electrostatic actuator for releasing contact between all of the N segments of the diaphragm and the opposing wall.

7. The control method according to claim 6, further comprising, after said step (a), applying a drive voltage to the electrostatic actuator for maintaining contact between selected ones of the N segments of the diaphragm and the opposing wall.

8. The control method according to claim 6, wherein said step of applying the first drive voltage comprises charging the electrostatic actuator to the first drive voltage;

wherein said step of applying the second drive voltage comprises a first discharging step for discharging the electrostatic actuator to the second drive voltage at a first discharge rate after a first predetermined time has passed after said step of charging the electrostatic actuator; and the control method further comprising a second discharging step for discharging the electrostatic actuator at a second discharge rate from a selected voltage for maintaining contact between selected ones of the N segments of the diaphragm and the opposing wall, after said first discharging step;

wherein the second discharge rate is slower than the first discharge rate.

9. The control method according to claim 8, wherein said step of charging and said first discharging step, and said second discharging step are performed according to externally supplied print signals.

* * * * *